US011411334B2

(12) United States Patent
Peterson et al.

(10) Patent No.: US 11,411,334 B2
(45) Date of Patent: Aug. 9, 2022

(54) ELECTRICAL CONNECTOR FOR CONNECTING TO FLAT-WIRE CONDUCTORS OF A FLEXIBLE PRINTED CIRCUIT

(71) Applicant: APTIV TECHNOLOGIES LIMITED, St. Michael (BB)

(72) Inventors: David R. Peterson, Aurora, OH (US); Joseph Sudik, Jr., Niles, OH (US); Duane Lee Brantingham, Cortland, OH (US); George A. Drew, Warren, OH (US)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 0 days.

(21) Appl. No.: 17/124,782

(22) Filed: Dec. 17, 2020

(65) Prior Publication Data

US 2021/0210882 A1 Jul. 8, 2021

Related U.S. Application Data

(60) Provisional application No. 62/956,903, filed on Jan. 3, 2020.

(51) Int. Cl.

| | |
|---|---|
| ***H01R 12/77*** | (2011.01) |
| ***H01R 13/24*** | (2006.01) |
| ***H01R 13/11*** | (2006.01) |

(52) U.S. Cl.

CPC ..... *H01R 12/774* (2013.01); *H01R 12/778* (2013.01); *H01R 13/112* (2013.01); (Continued)

(58) Field of Classification Search

CPC .... H01R 12/774; H01R 12/778; H01R 12/77; H01R 13/112; H01R 13/2464; H01R 13/2492; H01R 13/2435; H01R 2201/26

See application file for complete search history.

(56) References Cited

U.S. PATENT DOCUMENTS 2,856,592 A * 10/1958 Carlson ..... H01R 25/142 439/119
3,796,986 A * 3/1974 Tamburro ..... H01R 12/61 439/329

(Continued)

FOREIGN PATENT DOCUMENTS

| | | | |
|---|---|---|---|
| DE | 10007138 | A1 | 9/2000 |
| GB | 2404794 | B | 11/2005 |
| JP | 2001143795 | A | 5/2001 |

OTHER PUBLICATIONS

European Search Report dated Sep. 8, 2021. 8 pages.

*Primary Examiner* — Vanessa Girardi

(74) *Attorney, Agent, or Firm* — RMCK Law Group, PLC

(57) ABSTRACT

An electrical connector for connecting to flat-wire conductors of a flexible circuit (FC) is described. The electrical connector includes an elongated body, a split-blade terminal, and a spring terminal. The elongated body has a longitudinal axis. The split-blade terminal has two prongs separated by a distance and is configured to interface with an electrical terminal of an electrical device. The spring terminal is configured to mate with one or more of the flat-wire conductors within a connection area of the FC. The spring terminal and the split-blade terminal are positioned on the longitudinal axis at opposing ends of the electrical connector.

16 Claims, 9 Drawing Sheets

(52) U.S. Cl.
CPC ..... *H01R 13/2464* (2013.01); *H01R 13/2492* (2013.01); *H01R 2201/20* (2013.01); *H01R 2201/26* (2013.01)

(56) References Cited

U.S. PATENT DOCUMENTS 4,040,705 A * 8/1977 Huber ..... H01R 12/675
439/397
4,891,019 A 1/1990 Olsson
7,549,884 B2 * 6/2009 Soubh ..... G01R 1/06733
439/289

* cited by examiner

ELECTRICAL CONNECTOR FOR CONNECTING TO FLAT-WIRE CONDUCTORS OF A FLEXIBLE PRINTED CIRCUIT

CROSS-REFERENCE TO RELATED APPLICATION(S)

The present application claims the benefit of U.S. Provisional Application No. 62/956,903, filed on Jan. 3, 2020. The disclosure of this application is incorporated herein by reference in its entirety.

FIELD

The present disclosure generally relates to flexible circuits and, more particularly, to an electrical connector for connecting to flat-wire conductors of a flexible circuit.

BACKGROUND

Flat-wire, flexible circuits (FCs) provide a lighter and cheaper alternative to traditional wire harnesses for interconnecting electrical circuits of a vehicle. These FCs may consist of flat-wire conductors that are protected by an insulating body. Conventional methods used to create an electrical connection between a device and the FC include mechanically crimping, welding, soldering, or stitching a terminal of the device to the FC. Although such methods create an effective electrical connection, they require discrete leads that are separately terminated or spliced together.

SUMMARY

This document describes an electrical connector for connecting to flat-wire conductors of a flexible circuit (FC). These techniques include an electrical connector having an elongated body between a split-blade terminal and a spring terminal. The split-blade terminal has two prongs separated by a distance and is configured to interface with an electrical terminal of an electrical device. The spring terminal is configured to mate with one or more of the flat-wire conductors within a connection area of the FC.

In other aspects, a system includes a housing that surrounds a portion of an FC. The system also includes a plurality of flat-wire conductors of the FC that have an exposed section at a connection area of the FC that is positioned within the housing. In addition, the system includes a plurality of electrical connectors supported within the housing. The plurality of electrical connectors each have a spring terminal at a first end and a split-blade terminal positioned at a second end that is opposite the first end along a longitudinal axis. One or more of the plurality of spring terminals abut the exposed section of one or more of the flat-wire conductors based on a compression force. Also, the split-blade terminal has two prongs separated by a distance and is configured to interface with an electrical terminal of an electrical device.

This summary is provided to introduce simplified concepts for an electrical connector for connecting to flat-wire conductors of a flexible circuit, which is further described below in the Detailed Description and Drawings. This summary is not intended to identify essential features of the claimed subject matter, nor is it intended for use in determining the scope of the claimed subject matter.

BRIEF DESCRIPTION OF THE DRAWINGS

The details of one or more aspects of an electrical connector for connecting to flat-wire conductors of a flexible circuit are described in this document with reference to the following drawings. The same numbers are used throughout the drawings to reference like features and components:

FIGS. 4-1 and 4-2 illustrate front elevational views of different example implementations of an electrical connector according to some implementations of the present disclosure;

FIGS. 7-1 and 7-2 illustrate perspective views of the electrical connector according to some implementations of the present disclosure;

DETAILED DESCRIPTION

Figure 1:
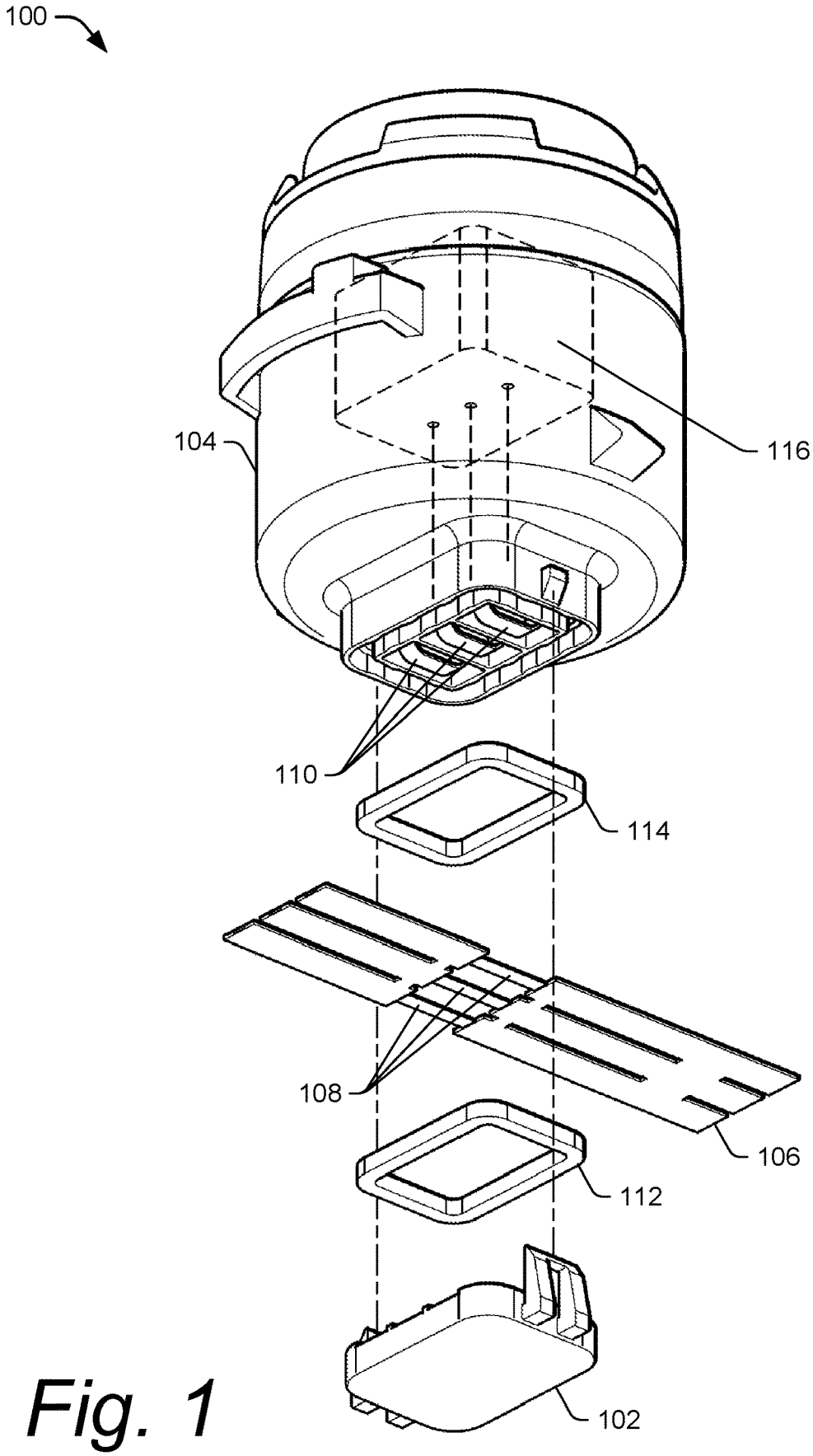
FIG. 1 illustrates an exploded view of an example system in which an electrical connector for connecting to flat-wire conductors of a flexible circuit can be implemented according to some implementations of the present disclosure.

The details of one or more aspects of an electrical connector for connecting to flat-wire conductors of a flexible circuit (FC) are described below. While flexible printed circuits (FPCs) are primarily discussed and shown herein, it will be appreciated that the present disclosure is directed to any type of FC. The conductive circuit traces or "flat-wire conductors" of an FC could be applied, for example, using any suitable deposition process, including, but not limited to, deposition processes (physical/chemical vapor deposition, sputtering, etc.) and printing processes (screen printing, lithography, inkjet, etc.). An automobile may include many FCs that connect to various types of vehicle circuits, such as lighting systems, climate control systems, automated or assistive driving systems, sensor systems, electrical drive systems, engine control systems, and any other electrical component that connects to a flexible circuit in a vehicle. These FCs include flat-wire conductors made from aluminum or tin-plated copper. The flat-wire conductors are protected by an insulating body formed around the flat-wire conductors.

The insulating body exposes the flat-wire conductors at specific connection areas of the FC. These connection areas are shaped to accommodate an electrical connector. Seating the electrical connector onto a connection area of a FC couples connector terminals of the electrical connector to a vehicle circuit through one or more of the flat-wire conductors of the FC. Maintaining a physical connection sufficient for transferring electrical current can be challenging where vibration, misalignment, and/or debris are present.

An electrical connector for connecting to flat-wire conductors of a FC is described. The electrical connector includes a spring terminal positioned at a first end of an elongated body. The spring terminal is configured to mate with a flat-wire conductor of the FC based on a compression force along a longitudinal axis of the elongated body. The spring terminal may have bifurcated contacts to improve electrical performance when contaminants are in a contact area between the spring terminal and the flat-wire conductor. The spring terminal may also include one or more protrusions or indentations on a surface that abuts the flat-wire conductor to improve the physical connection at the contact area. In some aspects, the spring terminal has a substantial obround shape that flexes in a direction of the longitudinal axis. The spring terminal may also flex in one or more of roll, pitch, and yaw directions relative to the longitudinal axis. The spring terminal also promotes contact wipe when mated to the FC at an acute angle relative to the longitudinal axis.

The structure of the electrical connector allows flexion in multiple degrees of freedom, which can improve alignment and reduce adverse effects caused by vibration. The structure of the spring terminal promotes a strong pressure contact between the spring terminal and the FC, and also compensates for micro movement of the FC or relaxation of a housing that presses the FC onto the spring terminal. Further, the structure of the electrical connector enables easy automation. The electrical connector can be used in a multi-drop apparatus having multiple electrical connectors that can be connected to any location along the FC that has exposed flat-wire conductors.

FIG. 1 illustrates an exploded view of an example system 100 in which an electrical connector for connecting to flat-wire conductors of a flexible circuit can be implemented. The system 100 includes a first housing portion 102 and a second housing portion 104 that removably connect to one another to form an assembled housing. In aspects, the first housing portion 102 and the second housing portion 104 connect to one another on opposing sides of wiring 106 such that a portion of the wiring 106 is positioned within the assembled housing of the system 100. The first and second housing portions 102, 104 can include any suitable fastener system to secure the first and second housing portions 102, 104 to one another, such as snap features (e.g., cooperating hook and protrusion).

The wiring 106 is illustrated as substantially flat wire, such as a flexible circuit (FC) with a plurality of flat-wire conductors 108 that are exposed at a contact area to enable physical contact with one or more electrical connectors 110. The electrical connectors 110 supply electrical continuity between the wiring 106 and an electrical component (not shown). Contact portions of the electrical connectors 110 may have an arcuate shape, which is described in further detail below. The wiring 106 (e.g., FC) includes one or more substantially flat wires (e.g., flat-wire conductors 108) that are generally rectangular and encased in a non-conductive, flexible, plastic insulation to provide a cross-section aspect ratio of at least 2:1 with respect to width and height. As used herein, "generally rectangular" includes any shape having a width greater than its height in cross section and may include rectangular, parallelogram, trapezoid, oval, obround, and elliptical shapes. In some embodiments, the aspect ratio may be at least 3:1. In other embodiments, the aspect ratio may be at least 5:1. The flat-wire conductor 108 may be provided by non-stranded electrically conductive material, such as a flat copper wire plated with tin. Adjacent wires may be interconnected with insulation material that forms a webbing, which provides structural integrity to the wiring 106 during handling.

The system 100 also includes one or more seals, such as seal 112 and seal 114, supported by the first and second housing portions 102, 104, respectively, and arranged on opposing sides of the wiring 106 to provide weatherproofing.

The second housing portion 104 includes and encloses a sensor 116. The sensor 116 can include any suitable sensor, including an ultrasonic distance sensor, a temperature sensor, a pressure sensor, a voltage sensor, a current sensor, a camera, a radar sensor, or other electronic sensor. In this manner, the sensor 116 is integrated into the system 100 and forms part of the housing. The housing of the system 100 may vary from the configuration depicted, particularly the second housing portion 104, which may be integrated with an electrical component such as a lighting device, the sensor 116, or other electrical device.

Figure 2:
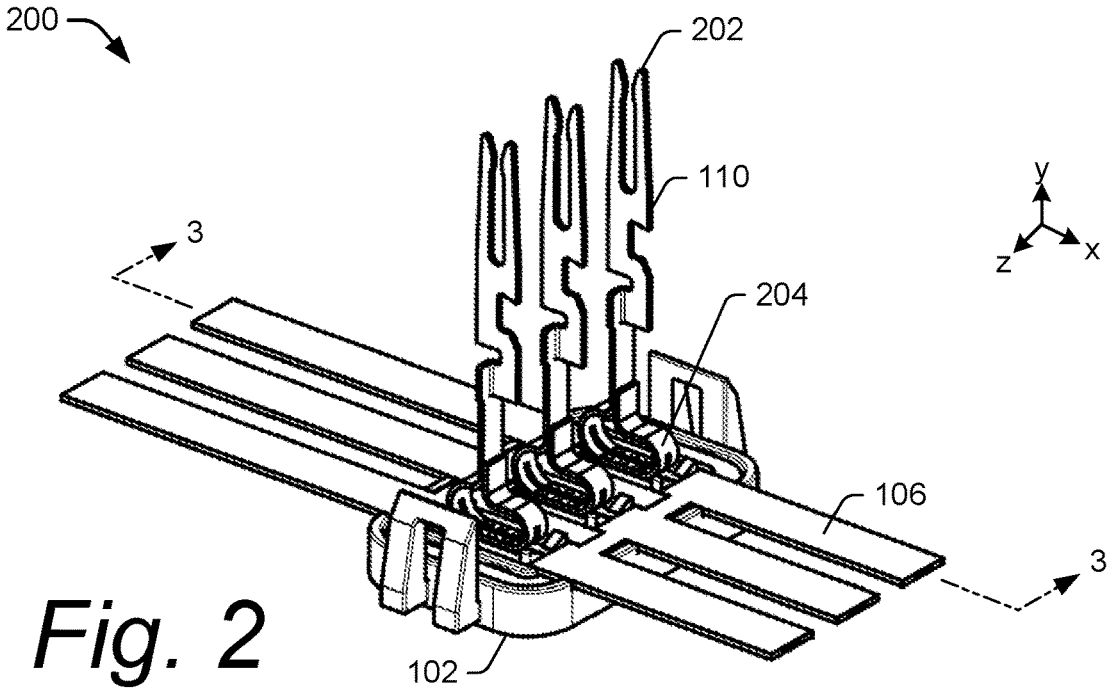
FIG. 2 illustrates a top front perspective view of a portion of the system from FIG. 1 according to some implementations of the present disclosure.

FIG. 2 illustrates a top front perspective view 200 of a portion of the system 100 from FIG. 1. This view 200 illustrates the electrical connectors 110 abutting the flat-wire conductors 108 of the wiring 106, which are backed by the first housing portion 102. As is described in further detail below, the electrical connectors 110 include a split-blade terminal 202 at one end and a spring terminal 204 at an opposing end.

Figure 3:
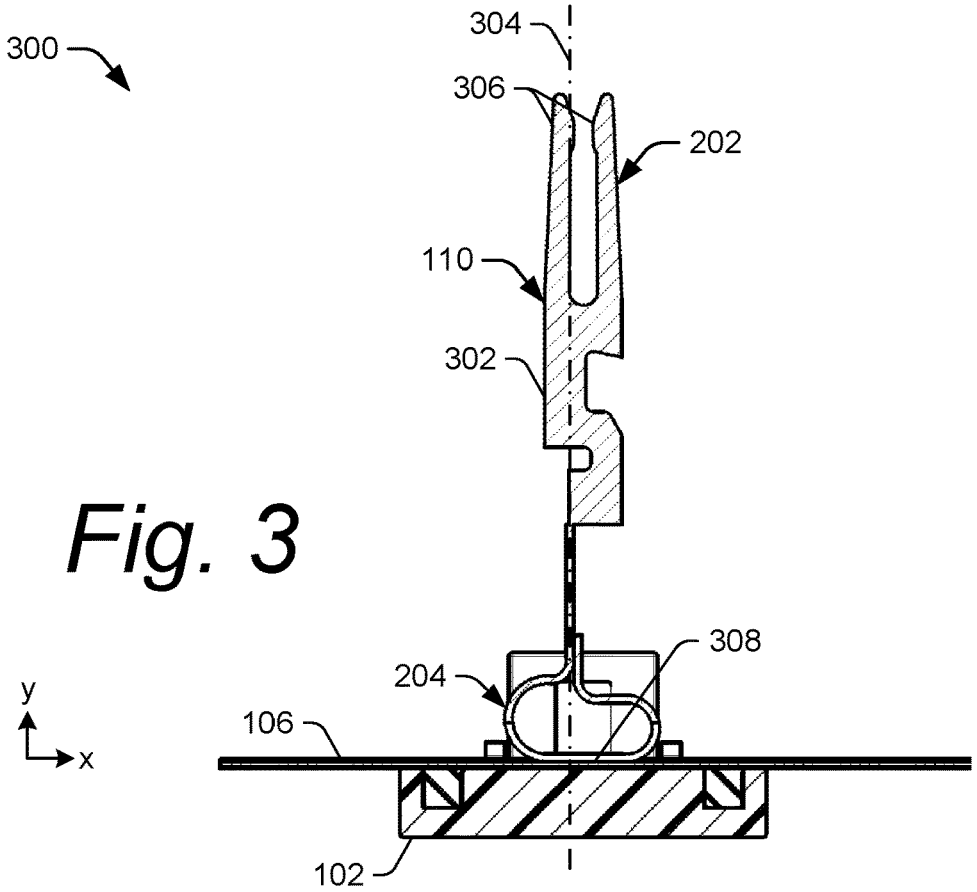
FIG. 3 illustrates a front sectional view of the portion of the system from FIG. 2, taken along section line 3-3 according to some implementations of the present disclosure.

FIG. 3 illustrates a front sectional view 300 of the portion of the system from FIG. 2, taken along section line 3-3. The electrical connector 110 includes an elongated body 302 with a longitudinal axis 304. The elongated body 302 has first and second opposing ends on the longitudinal axis 304. At the first end, the electrical connector 110 includes a split-blade terminal, such as the split-blade terminal 202 (shaped as a tuning fork). The split-blade terminal 202 has two prongs 306 configured to interface with an electrical terminal of an electrical component or device. In an example, the split-blade terminal 202 can pinch a flat-blade terminal or a pin terminal of the electrical component or device.

At the second end, the electrical connector 110 includes a spring terminal, such as the spring terminal 204. The spring terminal 204 is a type of leaf spring and may have a substantially obround, or stadium, shape. The shape of the spring terminal 204 provides longitudinal flexion along the longitudinal axis 304 when abutting the wiring 106 based on a compression force along the longitudinal axis 304 between the electrical connector 110 and the first housing portion 102. The substantial obround, or stadium, shape of the spring terminal 204 also includes a contact surface 308 for contacting the flat-wire conductors 108 (from FIG. 1) of the wiring 106. The contact surface 308 may have a portion that is substantially planar, which provides a contact area rather than a contact point for contacting the flat-wire conductors 108.

Figures 1, 4:
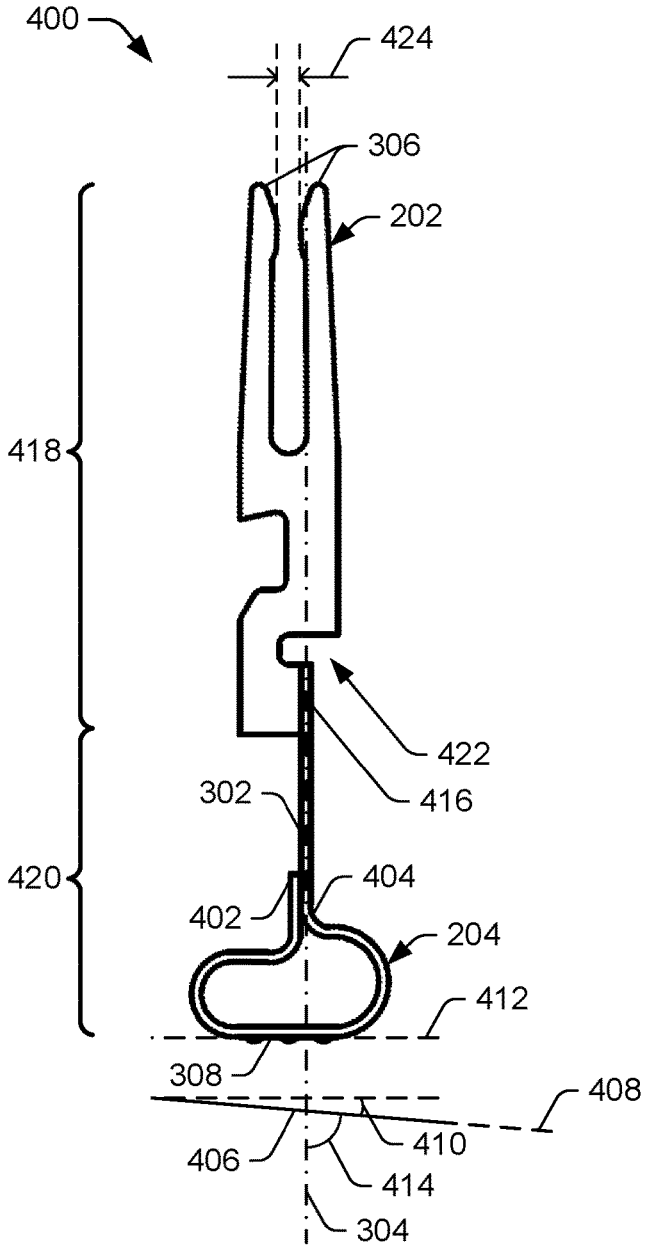
Figures 2, 4:
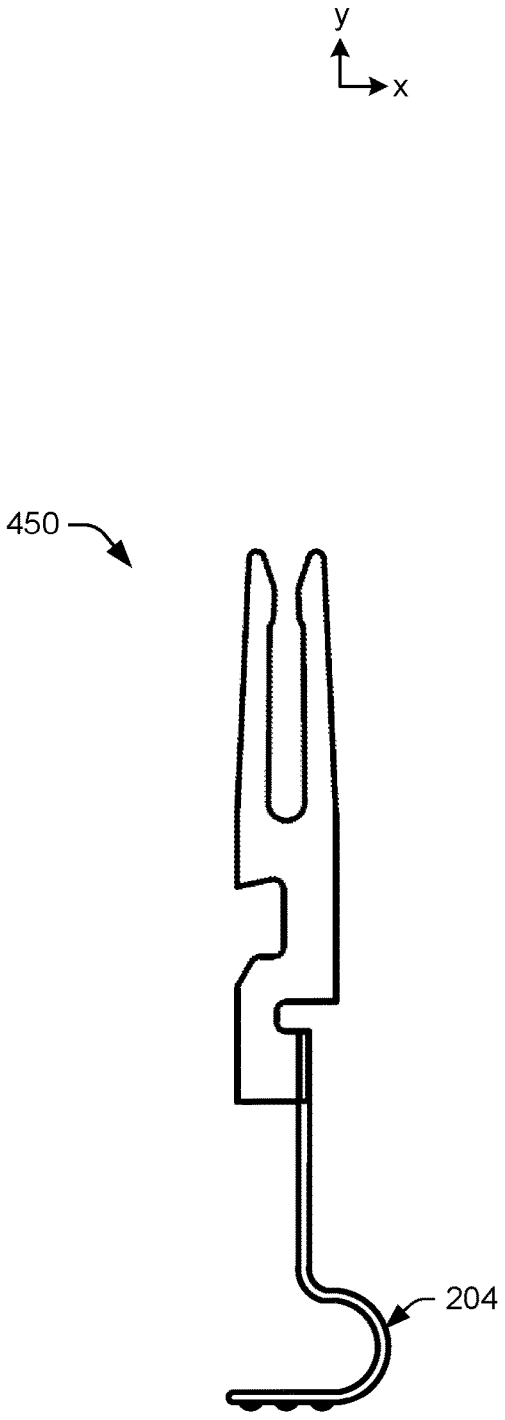

FIGS. 4-1 and 4-2 illustrate front elevational views 400 and 450, respectively, of different example implementations of the electrical connector 110. In FIG. 4-1, the spring terminal 204 is illustrated with a substantial obround shape having differently-sized semicircles at opposing sides. Alternatively, the semicircles may be substantially the same size.

The spring terminal 204 may be formed from a flat metal sheet that is bent to shape. The spring terminal 204 may include an end 402 that abuts the elongated body 302 proximate to a beginning portion 404 of the spring terminal 204. In aspects, the end 402 is not adhered to the elongated body 302 or the beginning portion 404 of the spring terminal 204. Rather, the end 402 is allowed to move or shift based on translational and/or rotational movement of the spring terminal 204 when the spring terminal 204 is compressed along the longitudinal axis 304 (e.g., in the y-direction) against the wiring 106. By not adhering the end 402 of the spring terminal 204 to the elongated body 302 or the beginning portion 404 of the spring, torsion caused by some angular force on the surface 308 of the spring terminal 204 is reduced.

The translational movement of the end 402 of the spring terminal 204 may occur in the y-direction based on the longitudinal compression force. The rotational movement (e.g., roll, pitch, or yaw) of the end 402 of the spring terminal 204 may occur based on the spring terminal 204 being compressed against an uneven surface, such as wiring with debris (e.g., dust particles, grain of sand or dirt, piece(s) of the wiring insulation, metal shavings, plastic, or any other object not intended to be between the spring terminal 204 and the wiring 106, or between the wiring 106 and the first housing portion 102 (e.g., on the opposite side of the wiring 106 from the spring terminal 204). The translational movement and/or the rotational movement of the end 402 of the spring terminal 204 may also occur based on the contact surface 308 of the spring terminal 204 being pressed against a surface, such as surface 406, which defines a plane 408 that forms an acute angle 410 relative to a plane 412 defined by the contact surface 308 of the spring terminal 204. The acute angle can also be defined relative to the longitudinal axis 304 of the electrical connector 110, such as acute angle 414 formed between the plane 408 of the surface 406 and the longitudinal axis 304 of the electrical connector 110. Any suitable acute angle can be used to promote contact swipe when the spring terminal 204 is pressed against the surface 406. Example acute angles between the plane 412 and the plane 408 may include any angle within a range of 5 to 20 degrees.

The elongated body 302 of the electrical connector 110 also includes one or more bends and/or notches to provide additional movement in multiple degrees of freedom. For example, the electrical connector 110 includes a bend 416 proximate (within a predefined distance) to a longitudinal midpoint of the elongated body 302. The bend 416 rotates an upper portion 418 of the electrical connector 110 relative to a lower portion 420 of the electrical connector 110 by approximately 90 degrees about the longitudinal axis 304.

Because the electrical connector 110 is formed from a flat metal strip, the lower portion 420 may flex about the z-axis, and the upper portion 418 may flex about the x-axis. This flexibility may allow for improved alignment over conventional, rigid connectors. In addition, the elongated body 302 may also include one or more notches, such as notch 422, which may enable additional rotational movement of the upper portion 418 relative to the lower portion 420 about the z-axis. The notches may also be used to receive a protrusion on the housing (not shown) of the system 100 in FIG. 1 to secure the electrical connector 110 within the housing. These notches and bends, combined with the thinness of the elongated body 302, also dampen vibration at the terminal ends of the electrical connector 110, e.g., at the spring terminal 204 and the split-blade terminal 202. Dampening vibration at the terminal ends may reduce the risk of disconnecting the electrical connector 110 from an electrical contact or from the flat-wire conductor 108. The flexibility of the electrical connector 110 may also improve alignment over conventional rigid connectors because the electrical connector 110 can flex in various directions to adjust for minor misalignment.

As described above, the split-blade terminal 202 has two prongs 306. The prongs 306 are separated by a predefined distance 424 such that, when the split-blade terminal 202 is connected to an electrical contact, such as a flat-blade terminal (e.g., 0.8 mm blade) or a pin terminal (e.g., 0.64 mm pin), the prongs 306 pinch the electrical contact to provide a physical connection for electrical continuity. The split-blade terminal 202 may also mate with other types of electrical contacts. Accordingly, the split-blade terminal 202 may be used as a multi-use terminal, such that it can interface with multiple different types of terminals.

FIG. 4-2 illustrates an alternative implementation of the electrical connector 110 in view 450. Here, the spring terminal 204 has an L-shape. This L-shape implementation provides similar flexibility to that described above and may reduce the amount of material used to generate the electrical connector 110. Any suitable shape can be used for the spring terminal 204, which includes a portion having a substantially planar surface for contacting the flat-wire conductors 108 of the FC, and a spring portion providing flexibility in one or more degrees of freedom.

Figure 5:
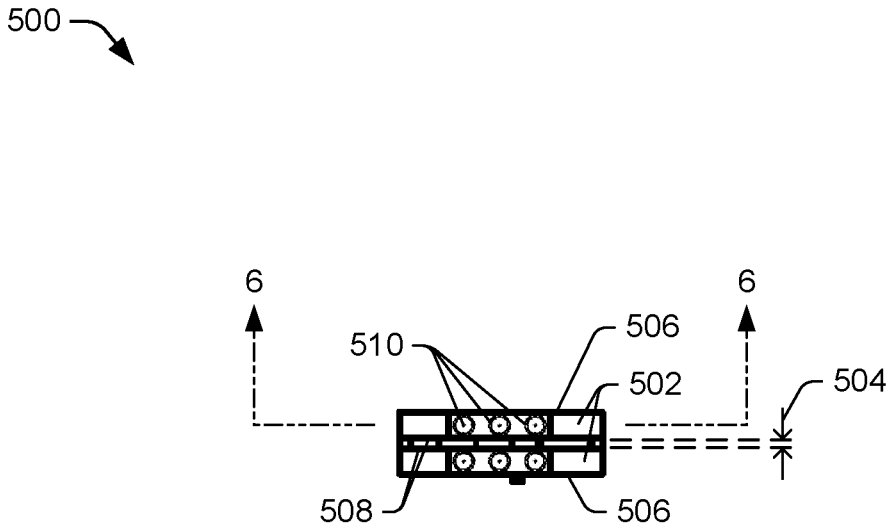
FIG. 5 illustrates a bottom plan view of the electrical connector according to some implementations of the present disclosure.

FIG. 5 illustrates a bottom plan view 500 of the spring terminal 204. The contact surface 308 of the spring terminal 204 may include bifurcated contacts 502, which are separated by a predefined distance 504. The bifurcated contacts 502 are configured to interface with the flat-wire conductors of the wiring 106. If debris prevents one of the bifurcated contacts 502 from contacting the wiring 106, the other bifurcated contact 502 may still provide the connection to the wiring 106.

The bifurcated contacts 502 each include an outer edge 506 and an inner edge 508 that contribute to maintaining contact with the wiring 106. The inner edges 508 are separated by the predefined distance 504 of the space between the bifurcated contacts 502.

One or both of the bifurcated contacts 502 may include one or more protrusions 510 (e.g., bumps, darts, knurls, ridges, serrations, etc.) configured to improve electrical connection with the wiring 106 by increasing the surface area of the contact surface 308. Additionally or alternatively, the bifurcated contacts 502 may include one or more indentations (e.g., notches, grooves, slots, channels, etc.) configured to improve electrical connection with the wiring 106 by increasing the surface area of the contact surface 308.

Figure 6:
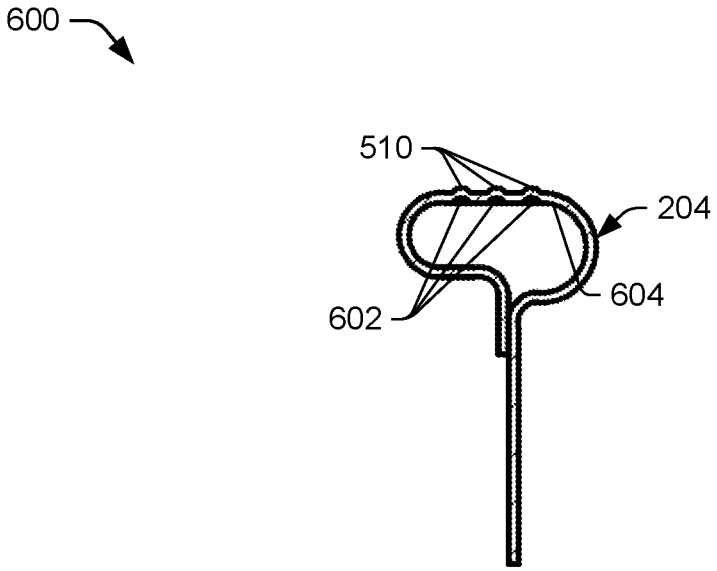
FIG. 6 illustrates a sectional view of the electrical connector from FIG. 5, taken along section line 6-6 according to some implementations of the present disclosure.

FIG. 6 illustrates a sectional view 600 of the spring terminal from FIG. 5, taken along section line 6-6. In aspects, the protrusions 510 on the contact surface of the spring terminal may have corresponding indentations 602 on an interior surface 604 of the spring terminal 204. These indentations 602 may be formed during a manufacturing process of the spring terminal 204 that stamps the metal strip on the interior surface 604 to form the protrusions on the contact surface 308 prior to bending the metal strip to form the spring terminal 204.

Figures 1, 7:
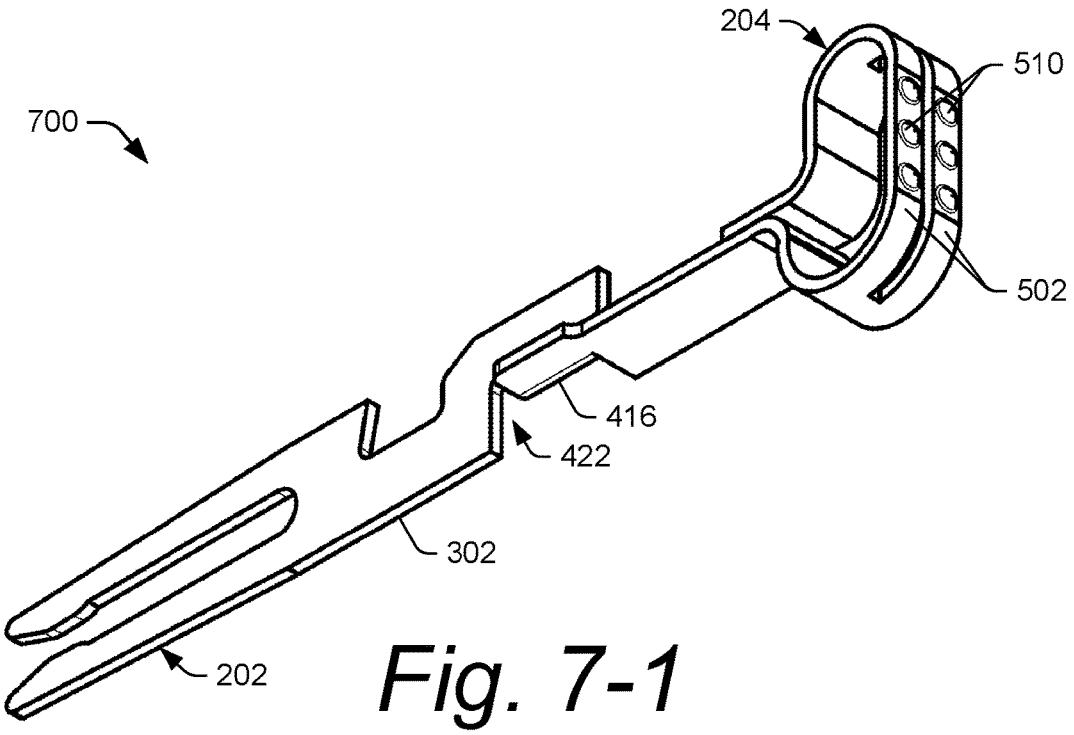
Figures 2, 7:
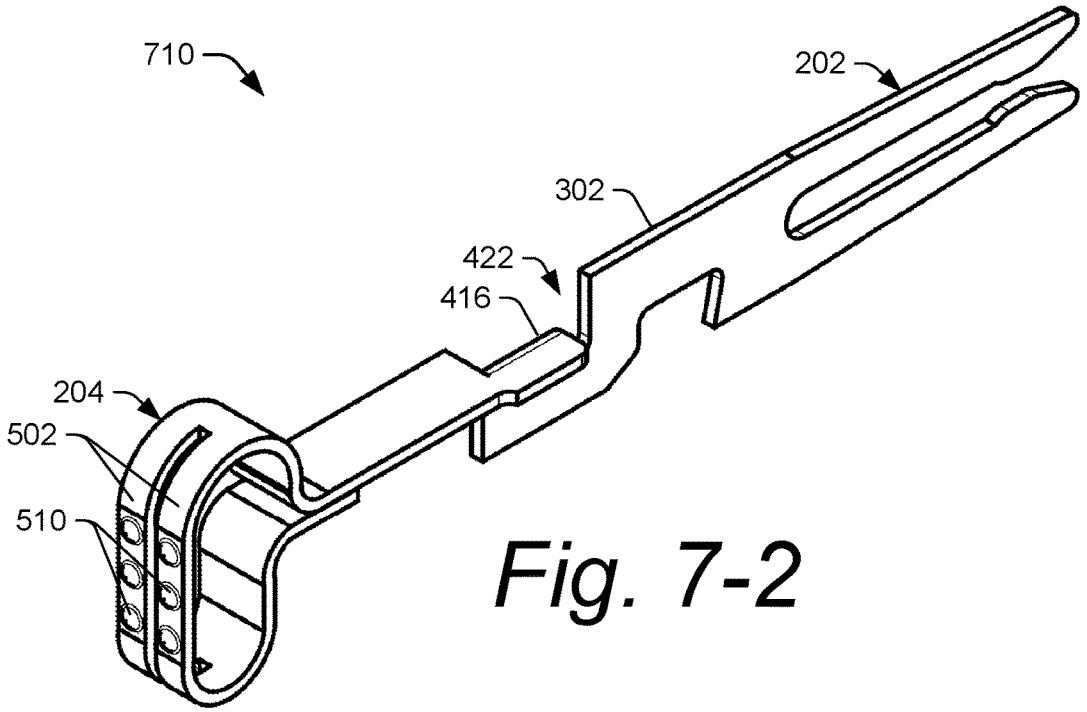

FIGS. 7-1 and 7-2 illustrate perspective views 700 and 710, respectively, of the electrical connector 110. As illustrated in FIGS. 7-1 and 7-2 and as described above, the electrical connector 110 includes an elongated body 302 with a spring terminal 204 at one end and a split-blade terminal 202 at an opposing end. The spring terminal 204 is configured to interface with a flat-wire conductor 108 of an FC. In aspects, the spring terminal includes bifurcated contacts 502 with one or more protrusions 510 and/or indentations (not shown). The elongated body 302 includes one or more bends 416 and/or notches 422 to provide flexibility in multiple degrees of freedom.

The electrical connector 110 can be manufactured using common methods of progressive metal forming. For example, a rectangular strip of metal can be stamped, cut, and bent to shape the electrical connector 110. First, an appropriately-sized strip of metal can be stamped or cut to create the split-blade terminal 202, the notches 422, the protrusions 510, and the space between the bifurcated contacts 502. Then, the elongated body 302 can be bent to create the bend 416 and the spring terminal 204.

Figure 8:
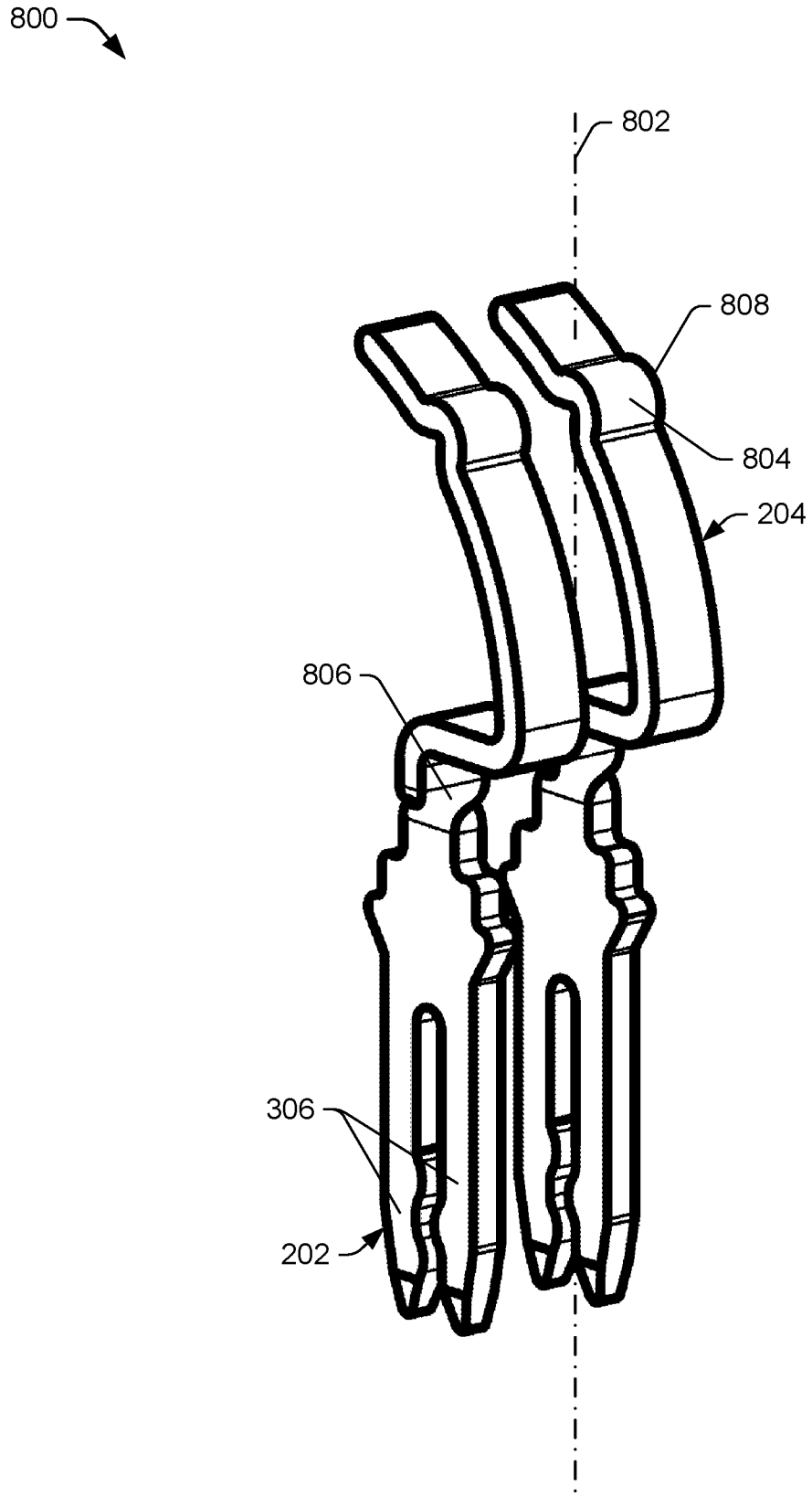
FIG. 8 illustrates a top front perspective view of an example implementation of the electrical connector according to some implementations of the present disclosure.

FIG. 8 illustrates a top front perspective view 800 of another example implementation of the electrical connector 110. In this illustrated example, the electrical connector 110 includes the split-blade terminal 202 at one end, which has prongs 306 configured to mate with a blade terminal or a pin terminal. At the opposing end, the electrical connector includes the spring terminal 204. The spring terminal 204 in this example has an arcuate shape (e.g., curved L-shape) and is configured to interface with an FC that does not run perpendicular to a longitudinal axis 802 of the electrical connector 110. Rather, the spring terminal 204 in this example has a contact surface 804 that is within a range of 30 to 60 degrees from the longitudinal axis 802. In aspects, the electrical connector 110 includes one or more bends (e.g., bend 806) such that the spring terminal 204 and the split-blade terminal 202 are rotated relative to one another about the longitudinal axis 802 by approximately 90 degrees. The spring terminal 204 also includes a protrusion, such as protrusion 808.

Figure 9:
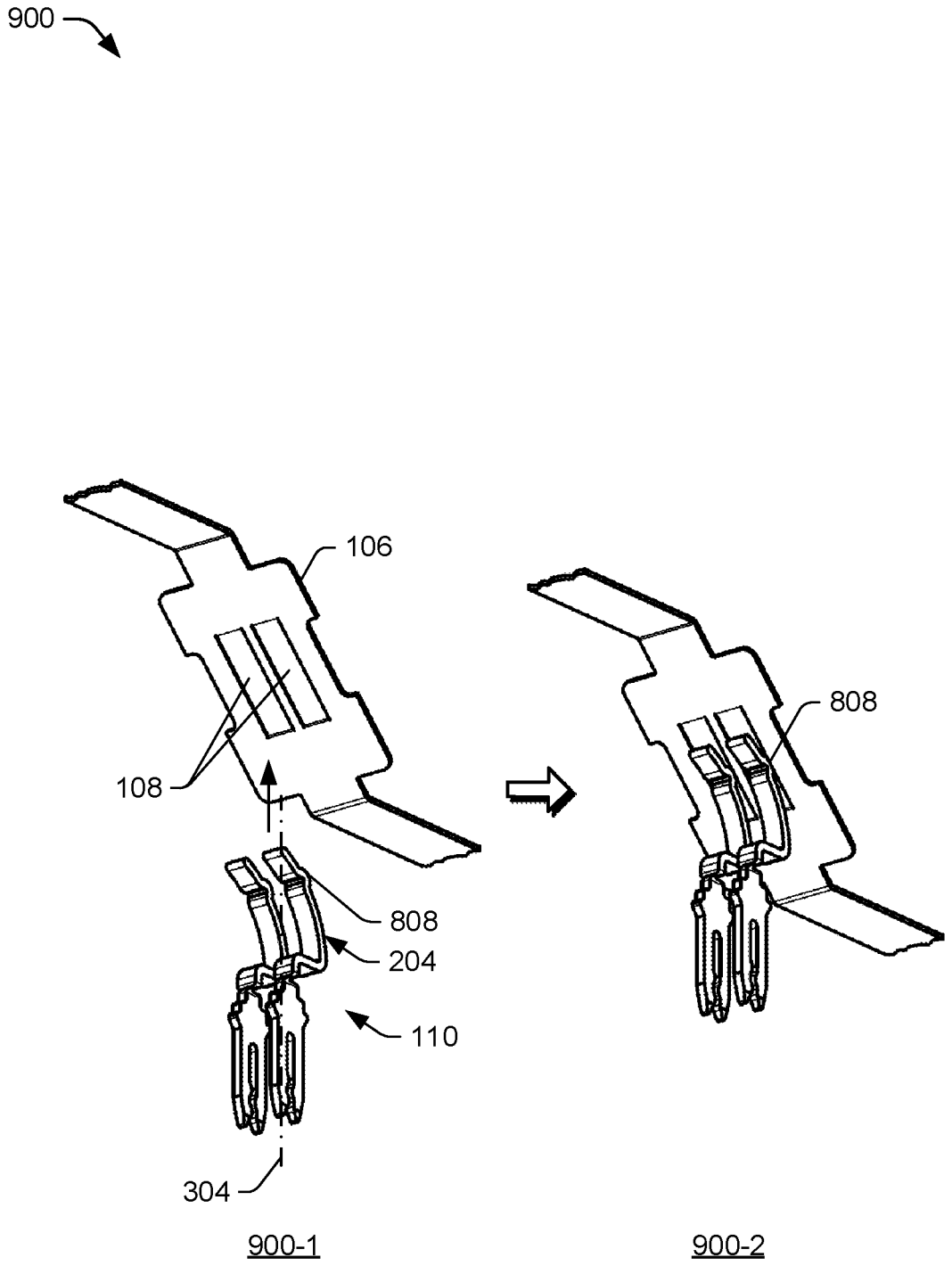
FIG. 9 illustrates an example implementation of the spring terminal from FIG. 8 connecting to the FC according to some implementations of the present disclosure.

FIG. 9 illustrates an example implementation of the spring terminal 204 from FIG. 8 connecting to the FC. View 900-1 illustrates the spring terminal 204 approaching the flat-wire conductors 108 of the wiring 106 in a direction corresponding to the longitudinal axis 304 of the electrical connector 110. In view 900-2, the electrical connector 110 is pressed against the flat-wire conductors 108, based on a longitudinal compression force along the longitudinal axis 304 of the electrical connector 110. Due to the angle of the contact not being perpendicular to the compression force, the protrusion 808 may slidably move along the flat-wire conductor 108 a short distance. This slidable movement may wipe away debris that might be on the flat-wire conductor 108, providing a clean surface to interface with the spring terminal 204.

Figure 10:
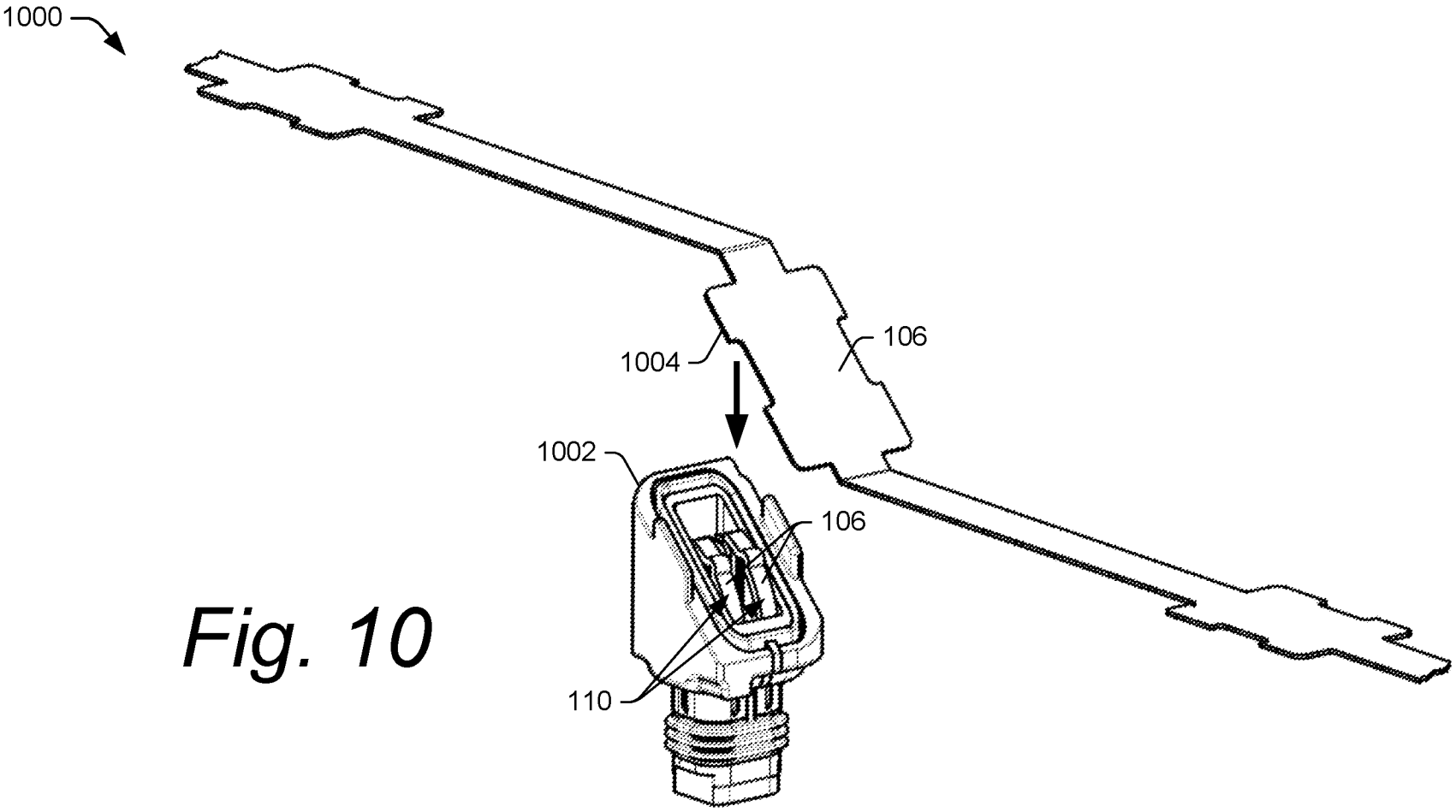
FIG. 10 illustrates a top front perspective view of an example system in which the electrical connector from FIG. 8 can be implemented to connect to the FC according to some implementations of the present disclosure.

FIG. 10 illustrates a top front perspective view 1000 of an example system in which the spring terminal 204 of FIG. 8 can be implemented to connect to the FC. In the illustrated example, a housing 1002 houses a pair of electrical connectors 110 such that the spring terminals 204 of the electrical connectors 110 can be mated to a connection area 1004 of the wiring 106, which may be a flexible circuit. Here, the spring terminals 204 contact the flat-wire conductors 108 (from FIG. 1) exposed in the connection area 1004.

Figure 11:
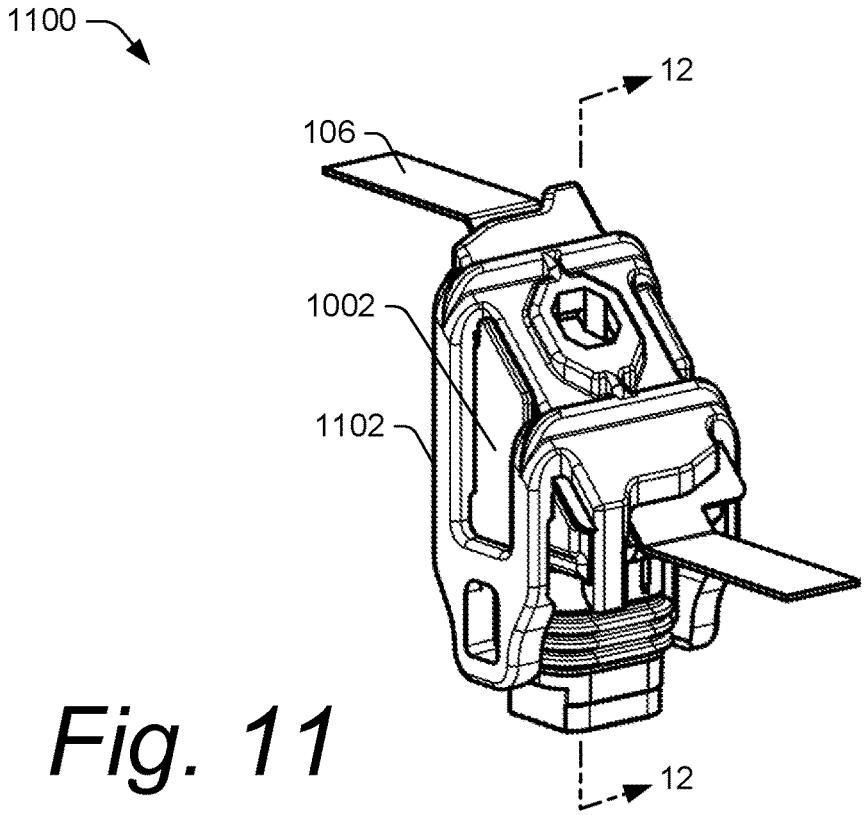
FIG. 11 illustrates a top front perspective view of an example connector in which the electrical connector from FIG. 8 can be used to connect with the FC according to some implementations of the present disclosure.

FIG. 11 illustrates a top front perspective view 1100 of an example connector in which the spring terminal from FIG. 8 can be used to connect with the FC. Here, the housing 1002 is connected to a retainer 1102 on opposing sides of the wiring 106. The retainer 1102 compresses the wiring 106 against the spring terminals 204 of the electrical connectors 110 housed within the housing 1002 and secures the wiring 106 in place, which maintains contact with the electrical connectors 110.

Figure 12:
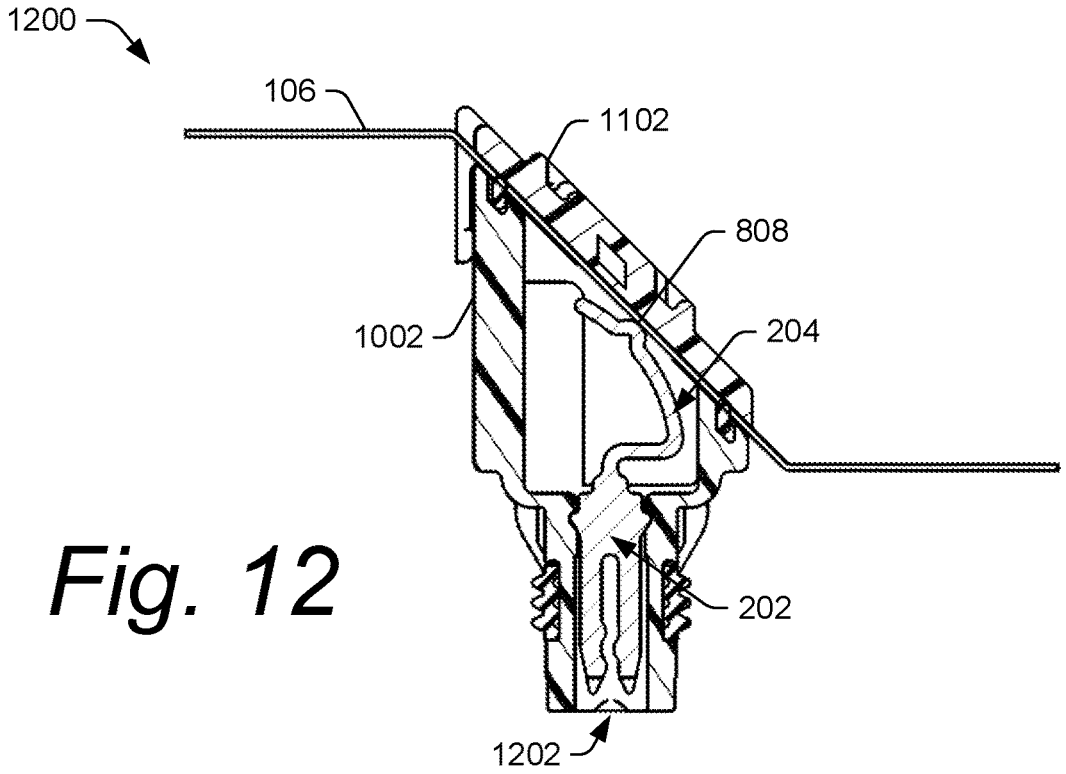
FIG. 12 illustrates a sectional view of the connector in FIG. 11, taken along section line 12-12.

FIG. 12 illustrates a sectional view 1200 of the connector in FIG. 11, taken along section line 12-12. In the sectional view 1200, the spring terminal 204 is contacting the wiring 106 based on a compression force provided by the housing 1002 and the retainer 1102 being fastened together on opposing sides of the wiring 106. The compression force is in a longitudinal direction of the electrical connector 110. The housing 1002 includes an opening to allow an electrical component to mate with the split-blade terminal 202 of the electrical connector 110.

What is claimed is:

1. A system comprising:

a housing that surrounds a portion of a flexible circuit (FC);

a plurality of flat-wire conductors of the FC, the plurality of flat-wire conductors having an exposed section at a connection area of the FC that is positioned within the housing; and a plurality of electrical connectors supported within the housing, the plurality of electrical connectors each having a spring terminal at a first end and a split-blade terminal positioned at a second end that is opposite the first end, one or more of the plurality of electrical connectors abutting the exposed section of one or more of the flat-wire conductors based on a compression force, the split-blade terminal having two prongs separated by a distance and configured to interface with an electrical terminal of an electrical device, wherein the spring terminal of an electrical connector of the plurality of electrical connectors comprises bifurcated contacts that abut the exposed section of a flat-wire conductor of the plurality of flat-wire conductors.

2. The electrical connector of claim 1, wherein a contact surface of the bifurcated contacts defines a plane that forms an acute angle relative to the FC to promote contact wipe when the bifurcated contacts are mated to the flat-wire conductors.

3. The electrical connector of claim 1, wherein the bifurcated contacts include one or more indentations on a contact surface that is configured to interface with the one or more of the flat-wire conductors.

4. The electrical connector of claim 1, wherein the spring terminal has an approximate obround shape.

5. The electrical connector of claim 1, wherein the spring terminal has an arcuate shape.

6. The system of claim 1, wherein the plurality of electrical connectors each have an elongated body having a longitudinal axis with one or more bends or notches positioned between the spring terminal and the split-blade terminal, the one or more bends or notches enabling flexion in at least three degrees of freedom.

7. The electrical connector of claim 1, wherein the spring terminal is configured to mate with the one or more of the flat-wire conductors within the connection area of the FC based on a compression force along the longitudinal axis.

8. The electrical connector of claim 1, wherein the spring terminal comprises a contact surface configured to interface with the one or more of the flat-wire conductors of the FC, the contact surface defining a plane, the plane forming an angle with the flat-wire conductors in a range of 5 to 20 degrees.

9. The system of claim 1, wherein the bifurcated contacts define a plane that is substantially perpendicular to a longitudinal axis of the electrical connector.

10. The system of claim 1, wherein the bifurcated contacts define a plane that forms an acute angle relative to a longitudinal axis of the electrical connector.

11. The system of claim 1, wherein the bifurcated contacts of the spring terminal include one or more protrusions disposed on a surface that abuts the exposed section of the one or more of the flat-wire conductors.

12. The system of claim 1, wherein the plurality of electrical connectors each have an elongated body between the first end and the second end, the elongated body being flexible in three degrees-of-freedom including yaw, pitch, and roll.

13. The system of claim 1, wherein the system comprises a portion of a vehicle circuit within a vehicle.

14. A system comprising:

a housing that surrounds a portion of a flexible circuit (FC);

a plurality of flat-wire conductors of the FC, the plurality of flat-wire conductors having an exposed section at a connection area of the FC that is positioned within the housing; and a plurality of electrical connectors supported within the housing, the plurality of electrical connectors each having a spring terminal at a first end and a split-blade terminal positioned at a second end that is opposite the first end, one or more of the plurality of electrical connectors abutting the exposed section of one or more of the flat-wire conductors based on a compression force, the split-blade terminal having two prongs separated by a distance and configured to interface with an electrical terminal of an electrical device, wherein the plurality of electrical connectors each have an elongated body between the first end and the second end, the elongated body being flexible in three degrees-of-freedom including yaw, pitch, and roll.

15. The system of claim 14, wherein the spring terminal of an electrical connector of the plurality of electrical connectors comprises bifurcated contacts that abut the exposed section of a flat-wire conductor of the plurality of flat-wire conductors.

16. The system of claim 14, wherein the system comprises a portion of a vehicle circuit within a vehicle.

* * * * *